US006164019A

United States Patent [19]

Salley

[11] Patent Number: 6,164,019

[45] Date of Patent: Dec. 26, 2000

[54] DRY DECK RAIN TRAYS

[76] Inventor: Doug Salley, 18 Eppington La., Bella Vista, Ark. 72714

[21] Appl. No.: 09/201,595

[22] Filed: Nov. 30, 1998

[51] Int. Cl.[7] ..... E04D 13/00

[52] U.S. Cl. ..... 52/11; 52/14; 52/15

[58] Field of Search ..... 52/11–15, 302.1, 52/302.3, 478, 462

[56] References Cited

U.S. PATENT DOCUMENTS

| | | | |
|---|---|---|---|
| 4,065,883 | 1/1978 | Thibodeau . | |
| 4,257,716 | 3/1981 | Woodrow . | |
| 4,663,894 | 5/1987 | LaRoche et al. . | |
| 4,860,502 | 8/1989 | Mickelsen . | |
| 5,511,351 | 4/1996 | Moore | 52/11 X |
| 5,765,328 | 6/1998 | Moore | 52/11 X |

FOREIGN PATENT DOCUMENTS

| | | | |
|---|---|---|---|
| 1203089 | 1/1960 | France | 52/14 |
| 1247598 | 8/1967 | Germany | 52/14 |

*Primary Examiner*—Richard Chilcot
*Attorney, Agent, or Firm*—Trent C. Keisling; Head, Johnson & Kachigian

[57] ABSTRACT

The present invention is related to a deck guttering system which is able to harness seepage from between cracks and openings in the surface of a wooden deck and to direct the seepage in a desired path, typically away from the structure which the deck is attached. The present invention includes a trough which is connected to adjacent support joists irregardless of the dimension between the support joists.

12 Claims, 7 Drawing Sheets

DRY DECK RAIN TRAYS

BACKGROUND OF THE INVENTION

1. Field of the Invention

The present invention generally relates to drain gutters, or more specifically, the present invention relates to drainage guttering mounted below wooden decks and other apparatus which have joints and cracks which allow for moisture seepage.

2. Prior Art

Many residential homes and other structures have a wooden deck attached thereto. These decks are typically either a single level or multiple levels and are elevated above the ground. A wooden deck usually consists of a surface made up of a plurality of wooden planks laid side by side which are supported by a wooden frame consisting of a plurality of wooden joists. During the creation of such a deck, it is desirable to place the adjacent wooden planks as close together as possible, however, cracks develop between the planks which allow for moisture such as rain and snow melt-off to seep between the cracks. It is desirable to harness this seepage in order to prevent the seepage from effecting the foundation of the structure as well as any item located beneath the wooden deck.

Prior art discloses a few deck guttering systems which attempt to harness said seepage and direct it in a specific path. In U.S. Pat. No. 4,065,883 issued to Thibodeau on Jan. 3, 1978, a deck system which includes a panel having channels formed therein is disclosed. These panels fit over and between the joists of the deck. These panels, however, must be installed during the creation of the deck. Further, due to each panel being tapered with a downward slope the manufacturing of such a panel is expensive.

In U.S. Pat. No. 4,663,894 issued to LaRoche et al. on May 12, 1987, a flexible gutter could be used with concrete decks, such as parking garages, is disclosed. The gutter includes a flexible trough which is tapered in order to allow for the drainage of the collected moisture. The trough is connected to the deck by way of a pair of flanges. The deck is secured to the flanges by either crimping and folding together or by the use of an angle support in a generally z configuration.

The latter configuration is operational by the use of opposite forces, that is, the flanges are positioned a specific distance apart, the trough is then forced between the two flanges where it is secured. The disadvantage of the technique of securing the flanges to the deck itself creates the possibility of additional openings in the deck which can provide additional seepage. In addition, the flanges must be placed at a specific distance apart or else the trough will not be able to secure to the flanges.

U.S. Pat. No. 4,860,502 issued to Mickelsen on Aug. 29, 1989 discloses a deck guttering system to be used with wooden decks similar to the LaRoche system. The Mickelsen system utilizes a trough connected to a pair of flanges which are in turn connected to the joists of a wooden deck. The connection between the trough and the flanges is by way of interlocking members. However, in the event the support joists are more narrow or farther apart than the trough, the trough would be unable to connect to the flanges thus making this deck system inoperable.

There is a need then for a deck guttering system which can be installed after the construction of the deck without being connected to the deck surface itself and to allow for the varying widths between support joists.

SUMMARY OF THE INVENTION

The present invention is related to a deck guttering system which is able to harness seepage from between cracks and openings in the deck surface and to direct said seepage in a desired path, typically away from the structure which the deck is attached. The guttering system of the present invention includes a trough which will be referred to as a rain tray having a length longer than its width with horizontal flanges extending outward from each side. A pair of supports which connect to the horizontal flanges and to the interior walls of adjacent support joists. The novelty of the invention includes the ability of the rain tray to be connected to the supports irregardless of the dimension between the support joists. This allows for inexpensive manufacturing as well as on-site adjustments during the installation stage.

A primary objective of the present invention is to provide a novel deck guttering system that can be mounted beneath an existing deck.

Further object of the present invention is to provide a novel deck guttering system which can be mounted on the underside of an existing deck irregardless of the dimensions between support joists.

BRIEF DESCRIPTION OF THE DRAWINGS

FIGS. 4 through 8 are a sequence of illustrated perspective views of the present invention illustrated in FIG. 1 in which FIG. 4 shows a support rail being attached to a joist;

FIG. 5 illustrates a water proofing means having been attached to the mounting rail;

FIG. 6 illustrates a water proofing means being attached to the gutter portion of the present invention;

FIG. 7 illustrates the gutter portion being positioned between two joists; and FIG. 8 illustrating the completely installed guttering system of FIG. 1.

DETAILED DESCRIPTION OF THE PREFERRED EMBODIMENTS

Figure 1:
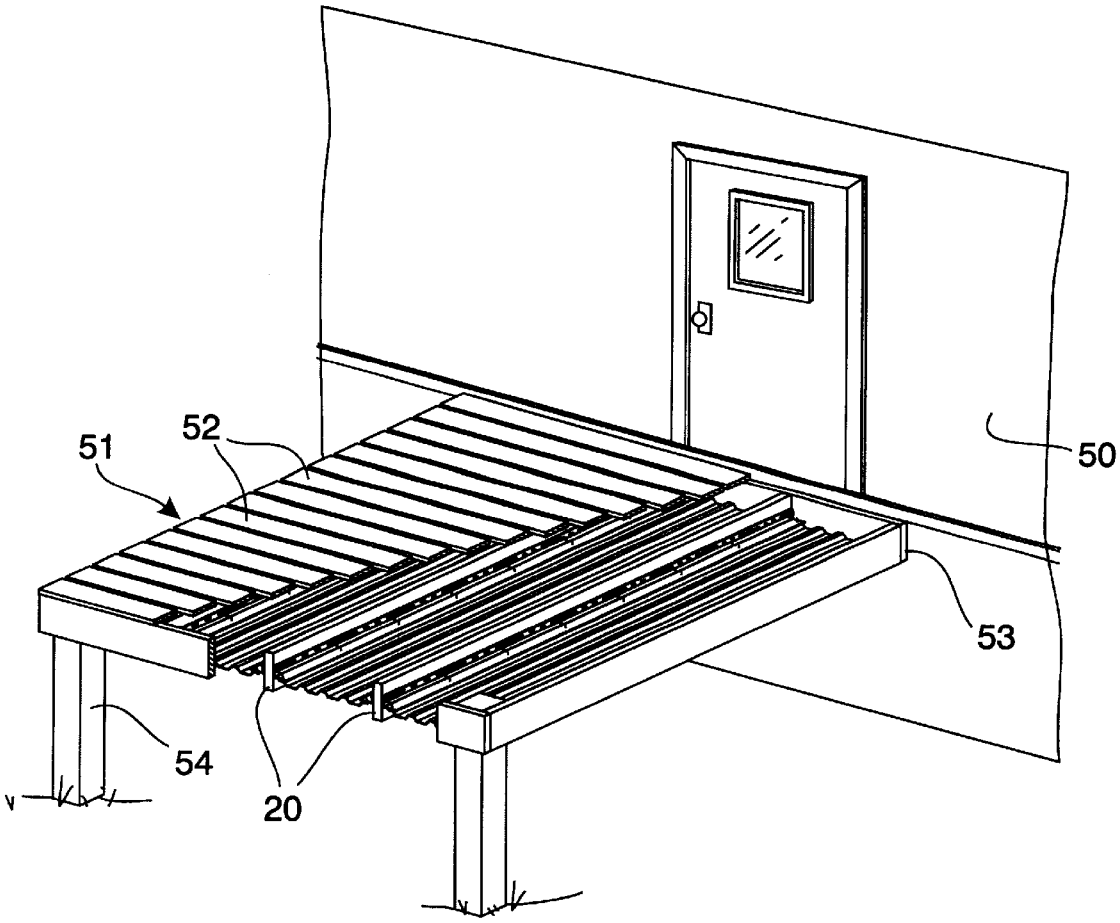
FIG. 1 is a perspective view of a deck with the deck guttering system of the present invention illustrated.

Referring in detail to the drawings, FIG. 1 illustrates a deck guttering system 5 having a plurality of rain trays 10 connected to a deck 53 in order to harness seepage and direct said seepage in a desired path. Deck 53 is typically connected to a building 50 and comprises a deck surface 51 having a plurality of planks 52 which are positioned side by side and connected to a plurality of joists 20 with said surface 51 being supported by a plurality of supports 54.

Figure 2:
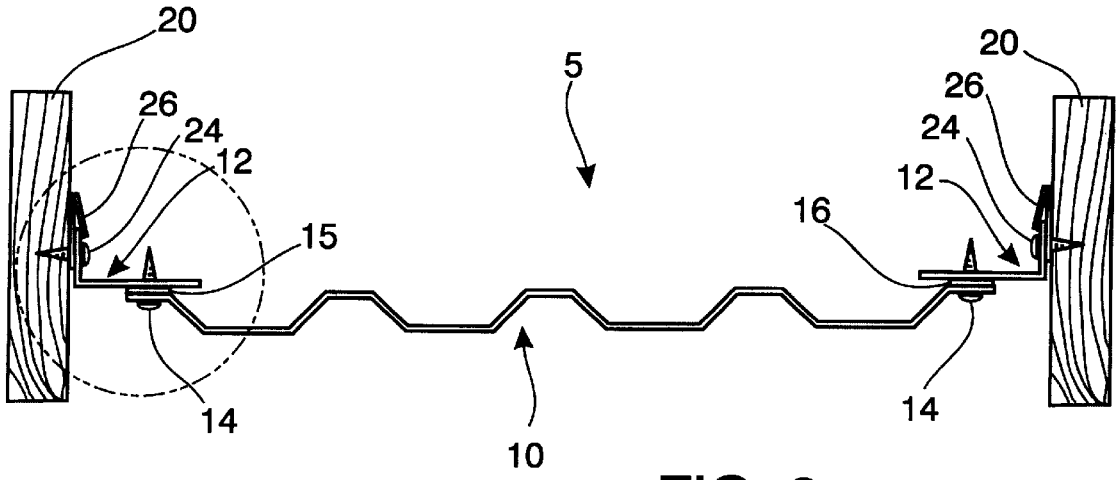
FIG. 2 is a transverse cross-sectional view of the present invention.

FIG. 2 illustrates a cross-section of the preferred embodiment of the present invention. Deck system 5 is shown having a rain tray 10 connected to two mounting rails 12 each of which are mirror images of the other. Each mounting rail 12 is connected to an interior wall of joists 20 by securing means 24 such as a screw. Rain tray 10 is connected each mounting rail by a securing means 14 such as a screw.

Figure 3:
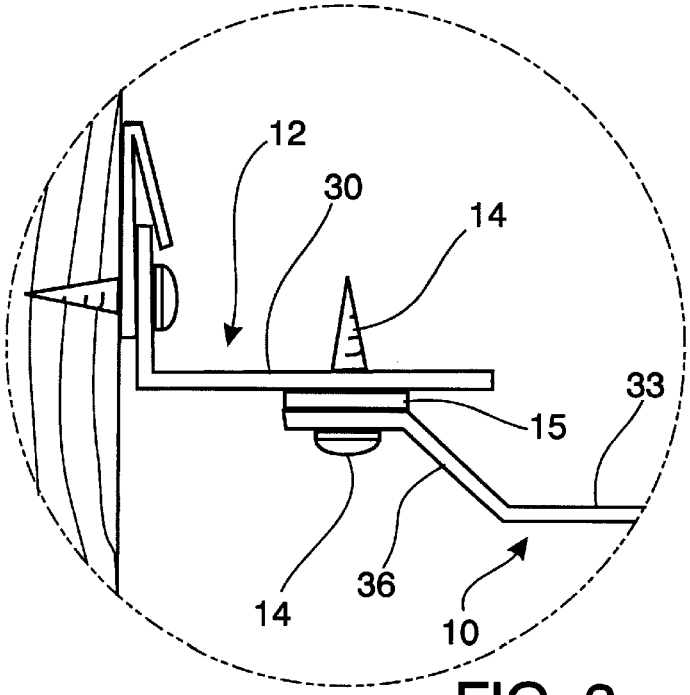
FIG. 3 is an enlarged view taken from FIG. 2 as illustrated by the enclosed section identified along circle 3.

As illustrated in FIG. 3, rain tray 10 has a body 33 which is generally rectangular in length with its length being longer than its width having a head end and a butt end, a first side and a second side with wall 36 extending outward from both first side and second side. Flange 34 extends away from body 33 and is connected to wall 36. Mounting rail 12 includes body 30, being generally rectangular with its length being longer than its width having a head end, a butt end, a first side, an opposing second side. Wall 32 extends outward from the first side of said rail. Wall 32 is secured to the interior wall of joists 20 by securing means 24. In order to prevent seepage to penetrate between the joists 20 and wall 32, water-proof tape 26 such as caulking tape is applied to the joists and the wall 32. Flange 34 is connected to body 30 by securing means 14, such as a screw, a double-sided water-proof tape 16, such as caulking tape is applied between flange 34 and body 30 in order to water-proof any openings between rain tray 10 and the mounting rail 12.

It should be noted that flange 34 can be attached to any portion of body 30 in order to allow for differences in the length between the interior joists 20.

Figure 4:
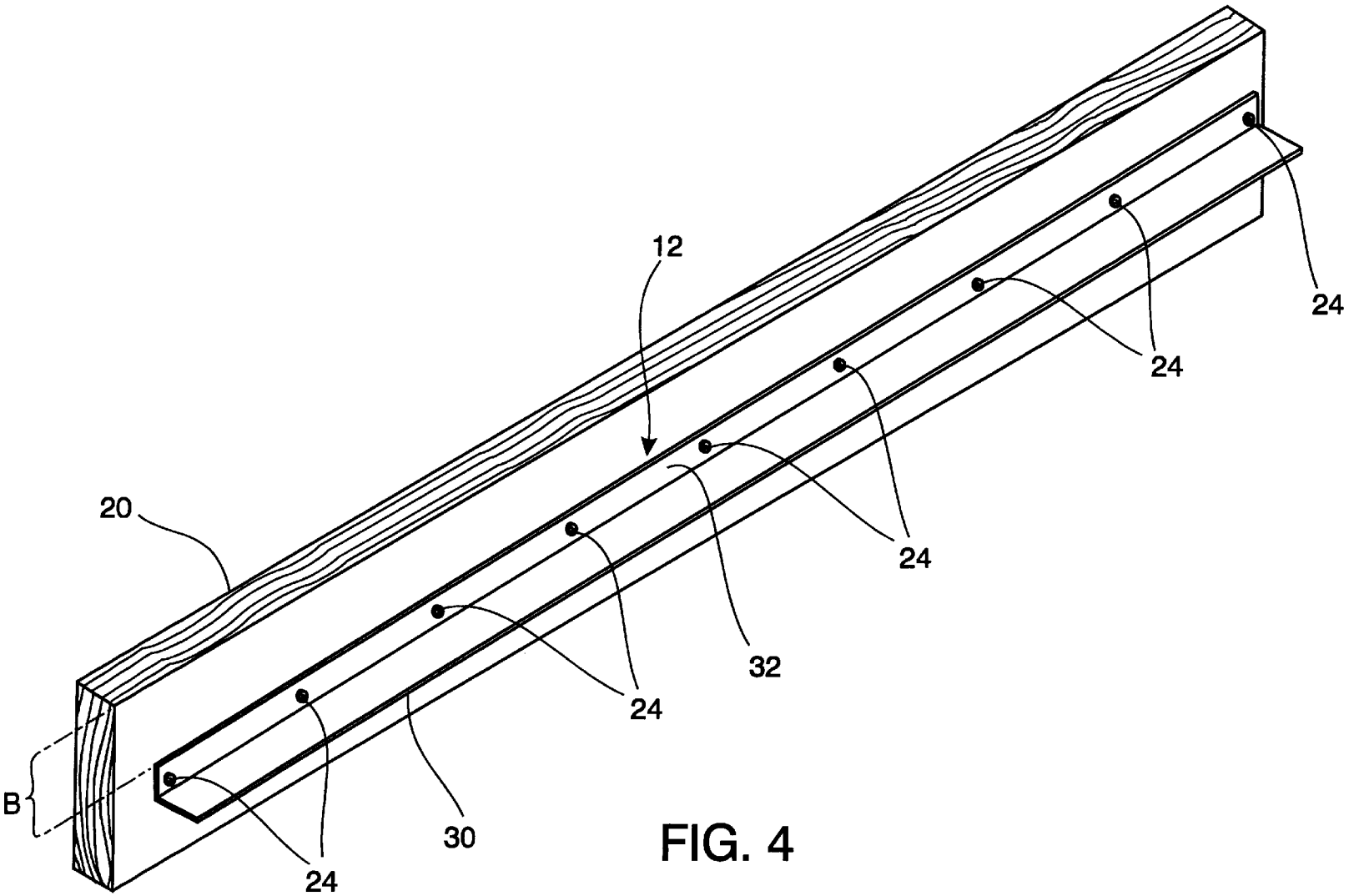

FIG. 4 illustrates a perspective view of mounting rail 12 secured to joists 20. As illustrated rail 12 in a sloping manner relative to joist 20.

Figure 5:
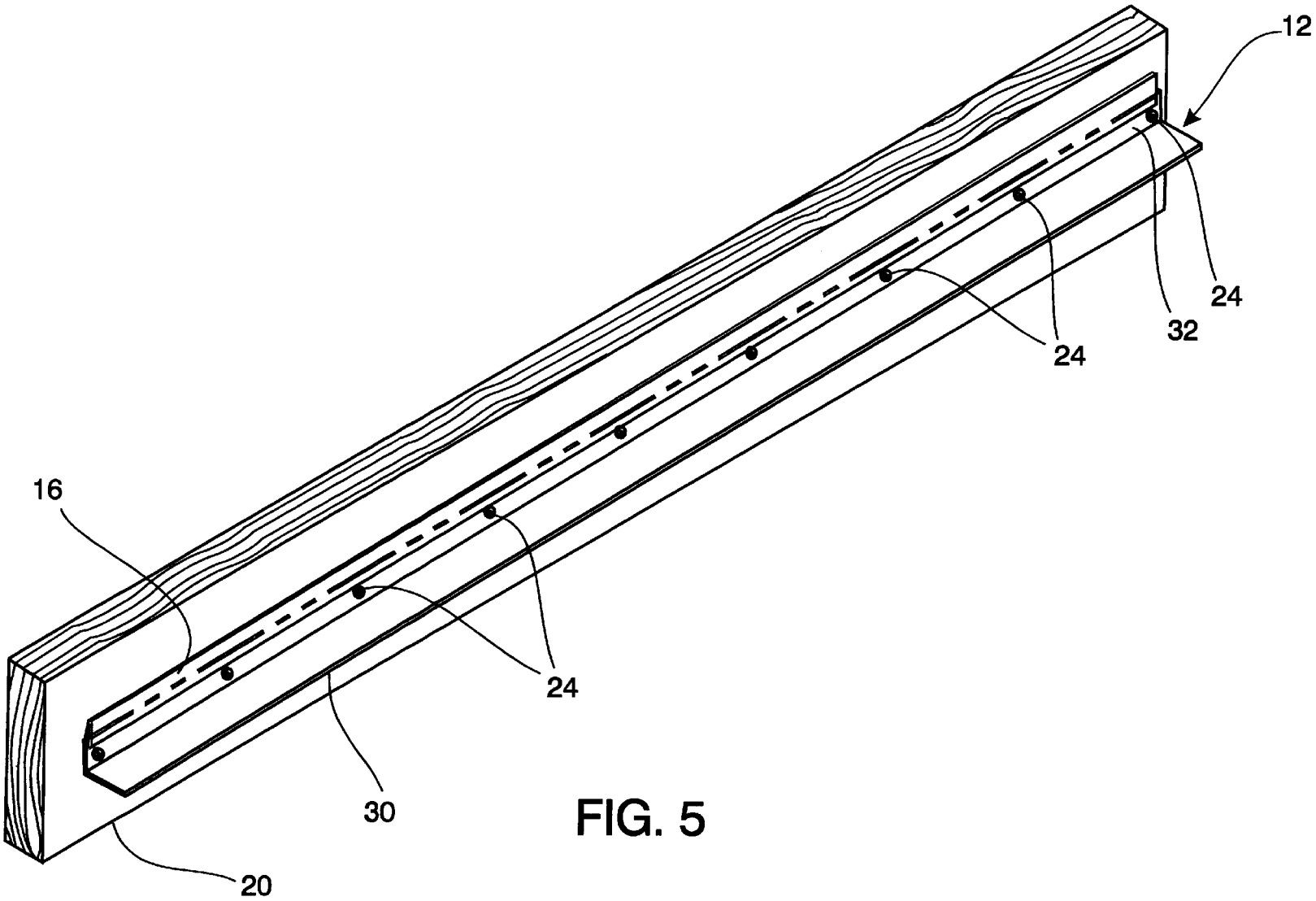

FIG. 5 illustrates a perspective view of rail 12 secured to joist 20. As described above and illustrated in FIG. 4 and having a waterproof means 16 such as a double sided caulking tape applied to wall 32.

Figure 6:
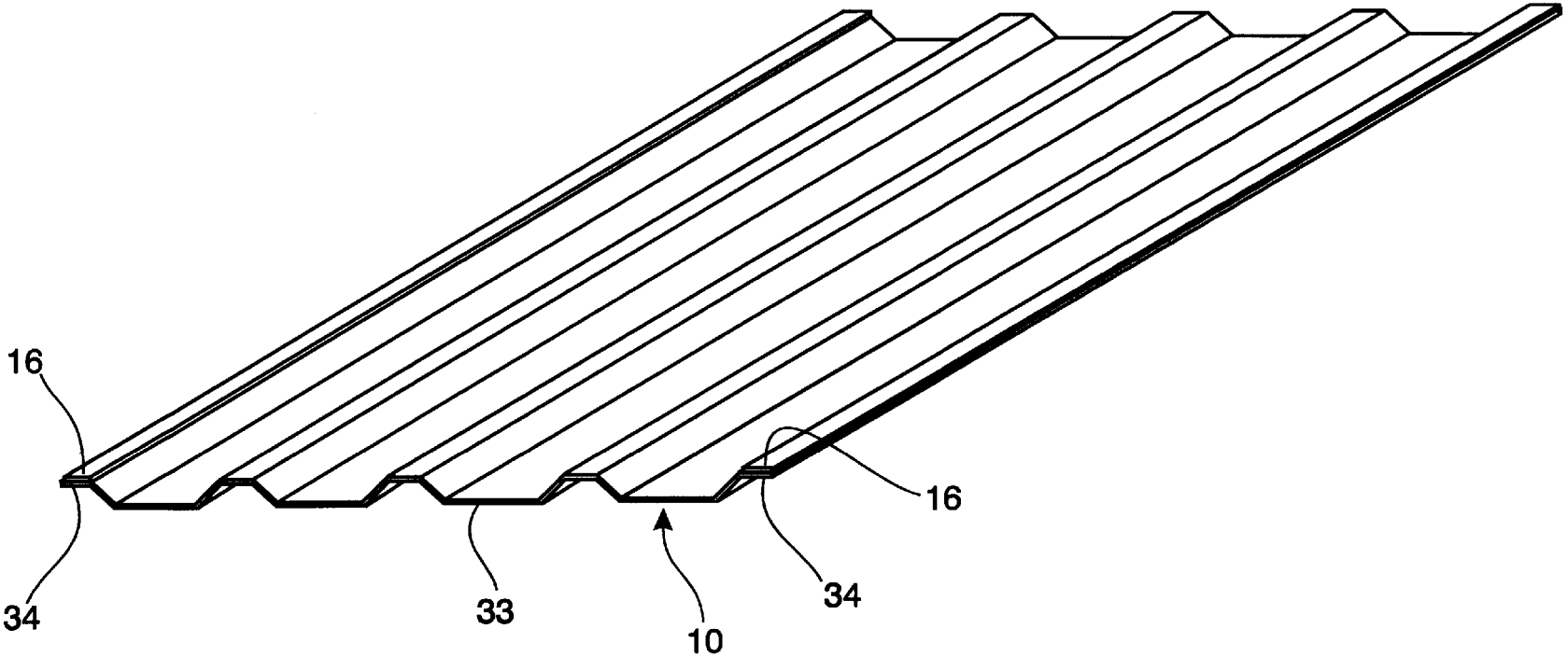

FIG. 6 illustrates rain tray 10 having a body 33 and flanges 34 extending away from body 33 having waterproof means 16 connected to flange 34.

Figure 7:
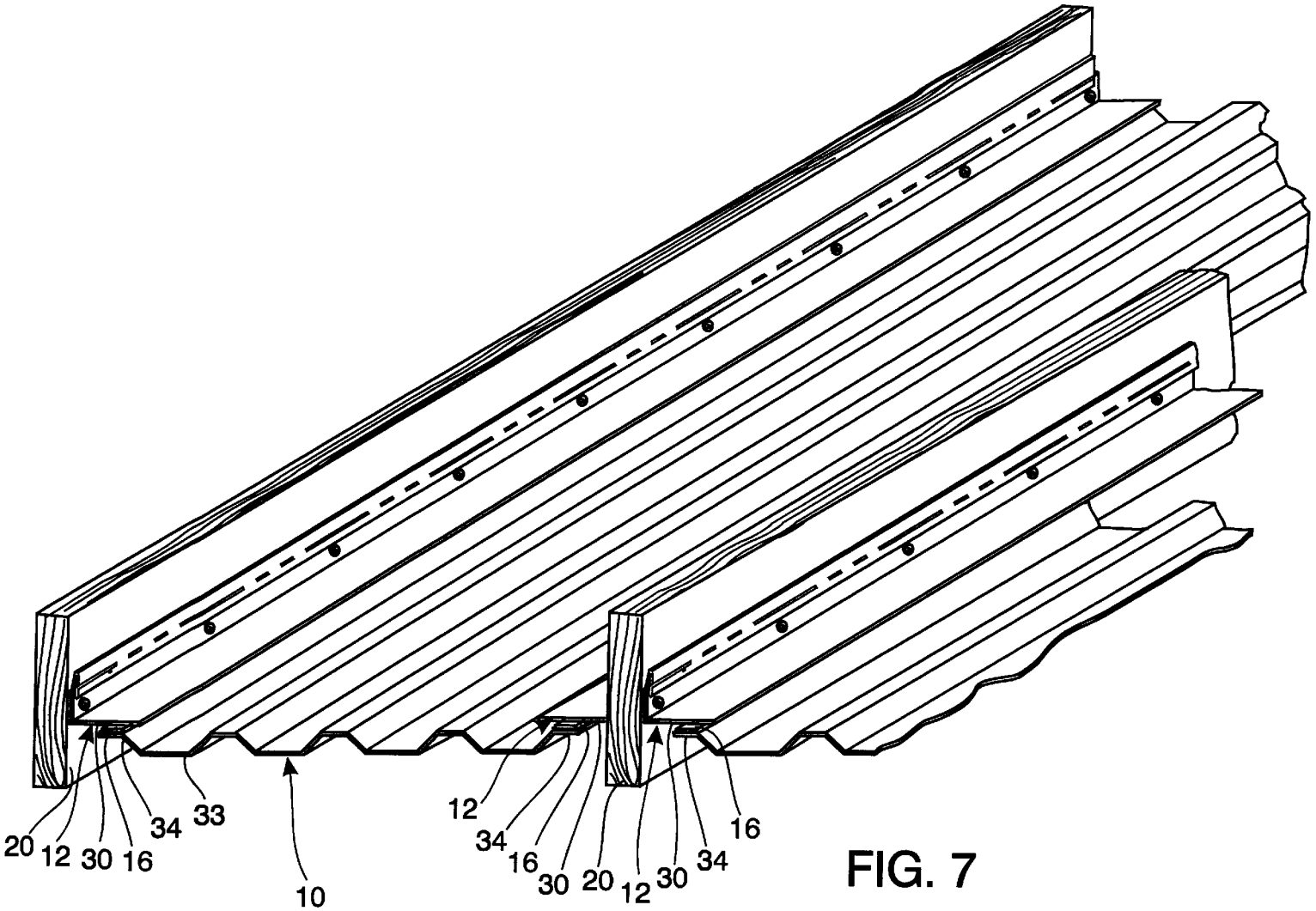

FIG. 7 illustrates rain tray 10 having waterproofing means 16 attached thereto just prior to being attached to corresponding rails 12 as set out herein.

Figure 8:
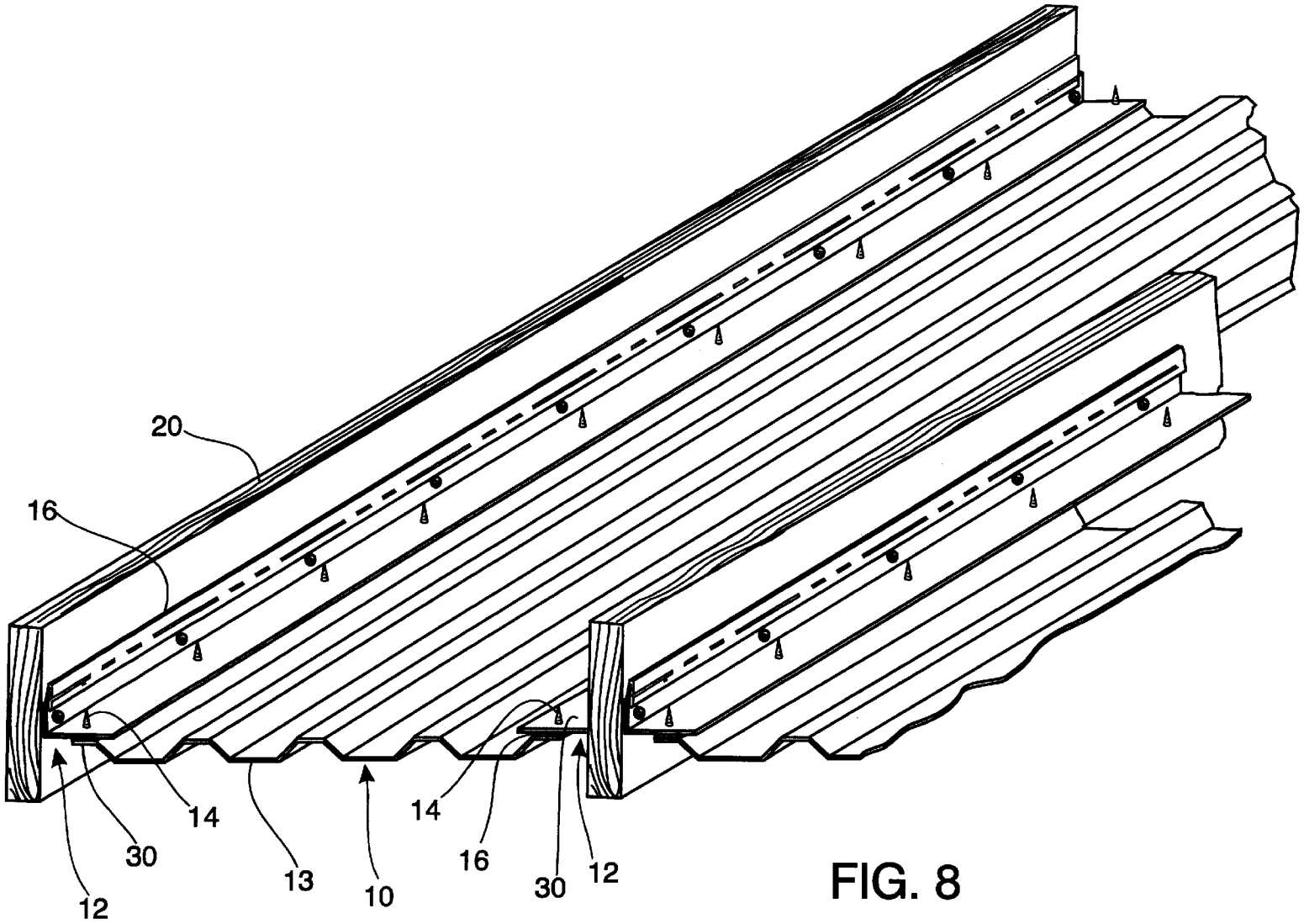

FIG. 8 illustrates a perspective view of a completed rain tray assembly of the present invention.

Whereas, the present invention has been described in relation to the drawings attached hereto, it should be understood that other and further modifications, apart from those shown or suggested herein, may be made within the spirit and scope of this invention.

What is claimed is:

1. A liquid drainage apparatus for mounting between two generally parallel, adjacent wooden deck joists, each having an exterior side and an interior wall, of a wooden deck connected to a building comprising:

a first mounting flange having a body being essentially rectangular with its length being greater than its width and defined by a butt end, a head end, a top, a bottom, a first side having a upstanding first wall extending outward from said side and a second opposite side, with the upstanding first wall of said first mounting flange secured to the interior wall of a first joist;

a second mounting flange having a body being essentially rectangular with its length being greater than its width and defined by a butt end, a head end, a top, a bottom, a first side and a second opposite side having a upstanding second wall extending outward from said side, with the upstanding second wall of said second mounting flange secured to the interior wall of an adjacent second joist; and a rain tray being essentially rectangular with its length being greater than its width and defined by a butt end, a head end, a top, a bottom, an upstanding first side having a first top edge, an upstanding opposite second side having a second top edge, a first horizontal flange located along the first top edge extending in a direction opposite the second side wall, and a second horizontal flange located along the second top edge extending in a direction opposite the first side wall, with the first horizontal flange secured by securing means to the body of the first mounting flange, and the second horizontal flange secured by securing means to the body of the second mounting flange.

2. The liquid drainage apparatus of claim 1 wherein the securing means are screws.

3. The liquid drainage apparatus of claim 1 wherein the first horizontal flange secured by securing means to the bottom of the first mounting flange, and the second horizontal flange secured by securing means to the bottom of the second mounting flange.

4. The liquid drainage apparatus of claim 1 wherein the first mounting flange and second mounting flange are secured in a generally angled manner such that liquid collected in the rain tray will be directed away from the building.

5. The liquid drainage apparatus of claim 1 further comprising:

waterproof caulk butyl applied along the connections between the upstanding first wall and the interior wall of the first joist, the upstanding second wall and the interior wall of the adjacent second joist, the first horizontal flange and the first mounting flange and the second horizontal flange and the second mounting flange.

6. The liquid drainage apparatus of claim 5 wherein the waterproof is a rubber-based butyl caulk.

7. A liquid drainage apparatus for mounting between two generally parallel, adjacent wooden deck joists, each having an exterior side and an interior wall, of a wooden deck connected to a building comprising:

a first mounting flange having a body being essentially rectangular with its length being greater than its width and defined by a butt end, a head end, a top, a bottom, a first side having a upstanding first wall extending outward from said side and a second opposite side, with the upstanding first wall of said first mounting flange secured by securing means to the interior wall of a first joist;

a second mounting flange having a body being essentially rectangular with its length being greater than its width and defined by a butt end, a head end, a top, a bottom, a first side, a second opposite side having a upstanding second wall extending outward from said side, with the upstanding second wall of said second mounting flange secured by securing means to the interior wall of an adjacent second joist; and a rain tray being essentially rectangular with its length being greater than its width and defined by a butt end, a head end, a top, a bottom, an upstanding first side having a first top edge, an upstanding opposite second side having a second top edge, a first horizontal flange located along the first top edge extending in a direction opposite the second side wall having a plurality of holes equally spaced along the length of said flange, and a second horizontal flange located along the second top edge extending in a direction opposite the first side wall having a plurality of holes equally spaced along the length of said flange, with the first horizontal flange secured by securing means to the bottom of the first mounting flange, and the second horizontal flange secured by securing means to the bottom of the second mounting flange;

with the first mounting flange and second mounting flange secured in a generally angled manner such that liquid collected in the rain tray will be directed away from the building; and waterproof applied along the connections between the upstanding first wall and the interior wall of the first joist, the upstanding second wall and the interior wall of the adjacent second joist, the first horizontal flange and the first mounting flange and the second horizontal flange and the second mounting flange.

8. The liquid drainage apparatus of claim 7 wherein the securing means are screws.

9. A method to install a liquid drainage apparatus, comprising in general a rain tray being essentially rectangular with its length being greater than its width and defined by a butt end, a head end, a top, a bottom, an upstanding first side having a first top edge, an upstanding opposite second side having a second top edge, a first horizontal flange located along the first top edge extending in a direction opposite the second side wall, and a second horizontal flange located along the second top edge extending in a direction opposite the first side wall; a first mounting flange and a second mounting flange for mounting between two generally parallel, adjacent wooden deck joists, each having an exterior side and an interior wall, of a wooden deck connected to a building comprising the following steps:

a. clean and dry the interior walls of a first joist and an adjacent second joist;

b. attach a first mounting flange to the interior wall of said first joist;

c. attach a second mounting flange to the interior wall of said adjacent second joist;

d. apply waterproof caulk to the connection between the first mounting flange and the first joist;

e. apply waterproof caulk to the connection between the second mounting flange and the adjacent second joist;

f. apply waterproof caulk to the first horizontal flange of said rain tray;

g. apply waterproof caulk to the second horizontal flange of said rain tray; and h. secure the rain tray to said mounting flanges.

10. The method of claim 9 wherein in steps b and c, the first mounting flange and second mounting flange are secured to the first joist and adjacent second joist by means of screws.

11. The method of claim 9 wherein in step h the rain tray is secured to said mounting flanges by means of screws.

12. The method of claim 9 wherein in steps b and c the first mounting flange and second mounting flange are secured in a generally angled manner such that liquid collected in the rain tray will be directed away from the building.

* * * * *